US008651302B2

(12) United States Patent
Lyda et al.

(10) Patent No.: US 8,651,302 B2
(45) Date of Patent: Feb. 18, 2014

(54) ELECTRICAL CONTACT COUPLING FOR A TRACK-BORNE VEHICLE, PARTICULARLY A RAILWAY VEHICLE

(75) Inventors: Martin Lyda, Hannover (DE); Brunhilde Wenge, Eichenbarleben (DE); Mario Hempel, Braunschweig (DE)

(73) Assignee: Voith Patent GmbH, Heidenheim (DE)

( * ) Notice: Subject to any disclaimer, the term of this patent is extended or adjusted under 35 U.S.C. 154(b) by 78 days.

(21) Appl. No.: 13/429,591

(22) Filed: Mar. 26, 2012

(65) Prior Publication Data

US 2013/0023139 A1 Jan. 24, 2013

(30) Foreign Application Priority Data

Mar. 28, 2011 (EP) ..... 11160046

(51) Int. Cl.
*B61G 5/10* (2006.01)

(52) U.S. Cl.
USPC ..... 213/1.3; 220/3.8; 220/252; 439/289

(58) Field of Classification Search
CPC ... B61G 5/10; H01R 13/5213; H01R 13/5219
USPC ..... 213/1.3, 1.6; 215/235; 220/242, 3.8, 220/810, 252, 849, 378; 49/495.1, 490.1, 49/475.1; 439/142, 136, 289; 277/921; 174/67; 68/196
See application file for complete search history.

(56) References Cited

U.S. PATENT DOCUMENTS

| | | | | |
|---|---|---|---|---|
| 1,790,292 | A * | 1/1931 | Van Dorn | 439/289 |
| 4,014,600 | A * | 3/1977 | Gisewsky | 439/289 |
| 6,105,403 | A * | 8/2000 | Carow et al. | 68/196 |
| 6,474,488 | B1 * | 11/2002 | Sullivan | 213/1.3 |

FOREIGN PATENT DOCUMENTS

| | | |
|---|---|---|
| DE | 100 15 420 A1 | 10/2001 |
| EP | 1 741 611 A2 | 1/2007 |
| JP | 2002-225705 | 8/2002 |
| JP | 2004-094363 | 3/2004 |
| JP | 2004-224221 | 8/2004 |
| JP | 2005-289108 | 10/2005 |
| JP | 2006-065141 | 3/2006 |
| JP | 2009-241673 | 10/2009 |

OTHER PUBLICATIONS

English Translation of the Japanese Office Action dated Jul. 9, 2013.

* cited by examiner

*Primary Examiner* — Mark Le
(74) *Attorney, Agent, or Firm* — Cesari and McKenna, LLP; Patricia A. Sheehan

(57) ABSTRACT

An electrical contact coupling for a track-borne vehicle has a coupling housing and a protective flap articulated to the coupling housing. In order to ensure a reliable sealing of the coupling housing in the closed state of the electrical contact coupling, a seal is utilized which exhibits an upper sealing area running parallel to the axis of rotation and a lower sealing area running parallel to the axis of rotation. The upper sealing area associates with a sealing face aligned perpendicular to the housing end face and the lower sealing area associates with a sealing face aligned substantially parallel to the housing end face.

23 Claims, 7 Drawing Sheets

ELECTRICAL CONTACT COUPLING FOR A TRACK-BORNE VEHICLE, PARTICULARLY A RAILWAY VEHICLE

BACKGROUND OF THE INVENTION

1. Field of the Invention

The invention relates to an electrical contact coupling for a track-borne vehicle, particularly a railway vehicle.

Electrical contact couplings are usually employed in rail vehicle technology to transmit control signals and power between two neighboring car bodies of a multi-member vehicle. The arrangement, control and size of the electrical contact couplings employed depend on the installation space available in the vehicle and on the number of signals to be transmitted as well as the requirements of the rail car manufacturer and/or the railway operator.

2. The Prior Art

Electrical contact couplings are usually configured such that two electrical contact couplings can be coupled and uncoupled automatically. To that end, the electrical contact couplings arranged on the vehicles or car bodies to be coupled are precisely joined together by means of centering devices and then the sealing surfaces configured on the end faces of the electrical contact couplings pressed together so as to achieve a reliable sealing against the environment. In the uncoupled state, a protective flap covers the end face of the electrical contact coupling in order to protect the coupling elements or any live contact elements of the electrical contact coupling there may be from contact and contamination.

For example, the DE 938 915 A printed publication discloses an electrical contact coupling for railway vehicles to couple electrical lines and signal lines. This electrical contact coupling comprises a coupling housing to be fixed to a car body of a railway vehicle, said housing being designed to accommodate coupling elements or contacts and exhibiting a coupling opening at its end face. The coupling opening can be closed by a protective flap mounted on the housing so as to be pivotable between a closed position and an open position.

In detail, this known prior art solution makes use of a relatively complex mechanism consisting of a plurality of articulated arms and pivot points in order to be able to pivot the protective flap relative to the coupling housing.

In order to simplify the mechanism employed to pivot the protective flap, it is in principle conceivable to connect the protective flap to the coupling housing by means of single-joint hinges such that the protective flap can be pivoted about a fixed axis of rotation. However, using single-joint hinges to pivot the protective flap does have the disadvantage that when the protective flap is in the closed position, the flap contour does not seat completely solidly on the sealing face of the coupling housing, respectively the sealing face of the coupling housing's front frame, and thus neither is an effective sealing usually possible, the main problem thereby being the lateral sealing gaps between the protective flap and the coupling housing. The lateral cracks thus present when the protective flap is in the closed position can allow the infiltration of dust, particularly metallic dust, and moisture, which can lead to reduced surface resistance. Abrasive dirt particles can also infiltrate, causing increased wear on the electrical contacts.

If additional seals are used to seal the lateral sealing gaps between the protective flap and the coupling housing in the closed position of the protective flap, friction acting on the lateral sealing elements cannot be avoided when the protective flap is opened and closed, which leads to increased wear on the lateral sealing elements.

SUMMARY OF THE INVENTION

The invention is based on the task of specifying an electrical contact coupling having a protective flap able to be pivoted relative the coupling housing by means of a simple mechanism which nevertheless achieves a greater seal against dust and moisture so as to reduce maintenance expenditures and also enable usage of coupling elements for optical data transmission.

This task is solved by the features of the present invention.

According thereto, the electrical contact coupling comprises a coupling housing having a housing opening configured on an end face of the housing and a seal at least sectionally encircling the housing opening. A protective flap is furthermore provided, which is articulated to the coupling housing such that the protective flap can be pivoted relative to the coupling housing about a fixed axis of rotation from a first position, in which the housing opening is covered, into a second position, in which the housing opening is exposed. In accordance with the invention, the seal exhibits an upper sealing area running substantially parallel to the axis of rotation as well as a lower sealing area running substantially parallel to the axis of rotation. The protective flap has a contact area which contacts the seal in order to seal the coupling housing in the first position of the protective flap. The section of the protective flap's contact area which contacts the upper sealing area in the first position of the protective flap is configured as a sealing face aligned substantially perpendicular to the housing end face. In contrast, the section of the protective flap's contact area which contacts the lower sealing area in the first position of the protective flap is configured as a sealing face aligned substantially parallel to the housing end face.

In one preferred realization of the solution according to the invention, the seal furthermore exhibits a lateral sealing area which connects the upper sealing area to the lower sealing area, wherein the section of the protective flap's contact area which contacts the lateral sealing area in the first position of the protective flap is configured as a three-dimensional sealing face. The lateral sealing area on the contact area section of the protective flap configured as a three-dimensional sealing face continuously adjoins the sealing face aligned substantially perpendicular to the housing end face to the sealing face aligned substantially parallel to the housing end face.

In conjunction hereto, it is particularly conceivable for the seal to be configured as a circumferential seal which thus exhibits, in addition to the upper and lower sealing areas, two lateral sealing areas which are configured mirror-symmetrical to one another and each respectively connect the upper sealing area to the lower sealing area. In order to achieve optimum sealing of the lateral sealing gaps in the closed state of the protective flap, it is provided for each section of the protective flap's contact area which contacts one of the two lateral sealing areas in the first position of the protective flap to be configured as a three-dimensional sealing face which continuously adjoins the sealing face aligned substantially perpendicular to the housing end face to the sealing face aligned substantially parallel to the housing end face.

The advantages which can be achieved with the inventive solution are obvious. By the protective flap being pivotable relative to the coupling housing about a fixed axis of rotation dispenses with the need for a complex mechanism to pivot the protective flap. Instead, the protective flap can be connected to the coupling housing by means of a single-joint hinge. Because no complicated hinging structure, for instance a four-joint system, etc., needs to be used to pivot the protective flap, the electrical contact coupling can be realized as a more simple structure on the whole and thus be of more economical and compact design.

On the other hand, the solution according to the invention provides for the protective flap to comprise a contact area contacting the seal connected to the housing end face, respectively the housing front frame, to seal the coupling housing in the first position of the protective flap. To this end, the contact area of the protective flap; i.e. that area of the protective flap which contacts the seal to seal the coupling housing in the first (closed) position of the protective flap, is constructed of a plurality of tangentially transitioning areas. Specifically, the section of the contact area which contacts the upper sealing area of the seal in the first position of the protective flap is configured as a sealing face aligned substantially perpendicular to the housing end face. In other words, the section of the contact area associated with the upper sealing area comes into contact with the seal from above when the electrical contact coupling is in the closed state.

In contrast, the section of the contact area which contacts the lower sealing area in the first position of the protective flap is configured as a sealing face aligned substantially parallel to the housing end face such that the section of the contact area associated with the lower sealing area comes into contact with the seal from the front when the electrical contact coupling is in the closed state.

In order to be able to also effectively seal the lateral sealing gaps between the upper and lower sealing area in the closed state of the electrical contact coupling, the invention provides for the seal to further comprise a lateral sealing area to connect the upper sealing area with the lower sealing area. The contact area of the protective flap exhibits an associated section corresponding to the lateral sealing area which contacts said lateral sealing area when the protective flap is in the first position. To prevent the section of the contact area allocated to the lateral sealing area from rubbing against the lateral sealing area when the electrical contact coupling is being opened; i.e. when the protective flap transits from its first (closed) position into its second (open) position, it is inventively provided for the section of the contact area associated with the lateral sealing area to be configured as a three-dimensional sealing face which continuously adjoins the sealing face aligned substantially perpendicular to the housing end face to the sealing face aligned substantially parallel to the housing end face.

The three-dimensionally configured sealing face is designed such that none of its areas strike the lateral sealing area of the seal until the end of the flap's closing motion, preferably not until the last 5 degrees of the flap's closing motion, and thus only minimum friction is generated.

As indicated above, the section of the contact area associated with the lateral sealing area is configured as a three-dimensional sealing face which continuously adjoins the sealing face aligned substantially perpendicular to the housing end face to the sealing face aligned substantially parallel to the housing end face. Hence, the section of the contact area configured as a three-dimensional sealing face is configured in the area of the sealing face associated with the upper sealing area so as to realize a radial contacting of the lateral sealing area from the outside in said area. Then again, the section of the contact area configured as a three-dimensional sealing face is configured in the area of the lower sealing area such that the lateral sealing area is contacted from the front.

It is noted at this point that the "upper" and "lower" directional indications used herein are independent of the positional bearing of the electrical contact coupling. The directional indications refer to the position of the protective flap in its open state. Regardless of the orientation of the electrical contact coupling, the indication of "upper" is to herein indicate the direction in which the protective flap is pivoted relative to the coupling housing when opening. The indication of "lower" is used for the correspondingly opposite directional indication. Furthermore, the indication of "from the front" as used herein is to be understood as the opposite direction to the coupling direction.

To achieve a complete sealing of the electrical contact coupling in its closed state, the seal is preferably configured as a circumferential seal which completely encircles the housing opening configured on the housing end face. It is hereby conceivable for the circumferential seal to be configured as an O-ring made from an elastomer material which is thus designed for both axial (from the front) as well as radial (from the outside) load.

BRIEF DESCRIPTION OF THE DRAWINGS

The following will make reference to the accompanying drawings in describing an embodiment of the present invention.

Shown are.

DESCRIPTION OF A PREFERRED EMBODIMENT

Figure 1:
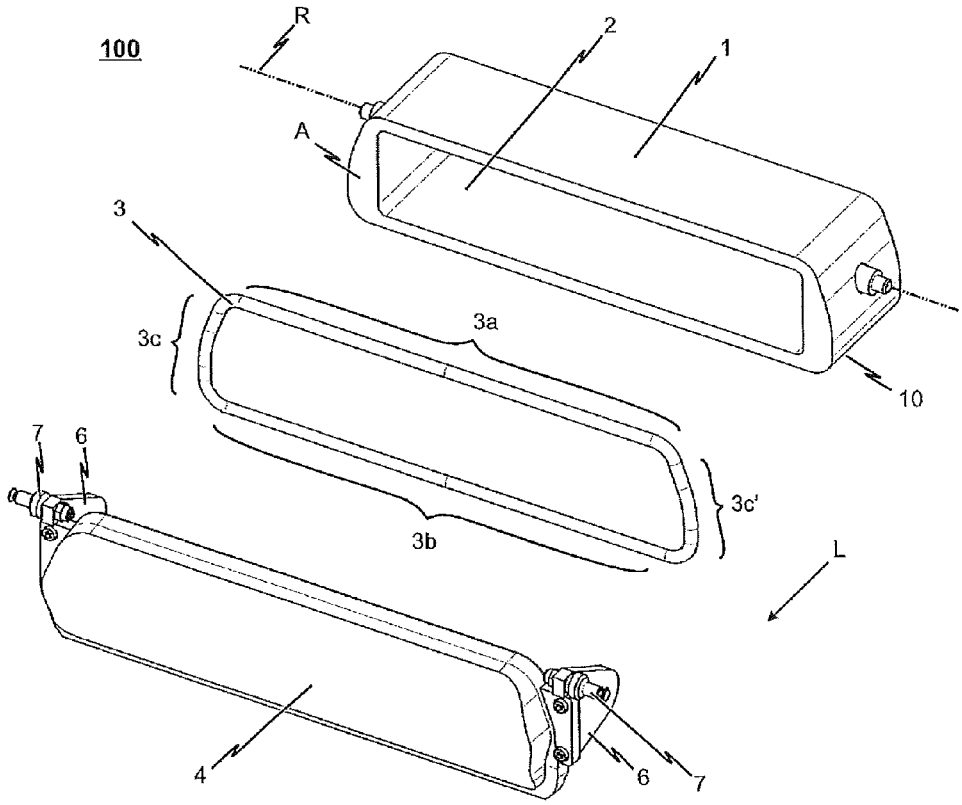
FIG. 1 an exploded view of one embodiment of the inventive electrical contact coupling.

The electrical contact coupling 100 depicted as an embodiment in the drawings is designed to be fixable to a track-borne vehicle, a railway vehicle in particular, such that the housing end face A of the electrical contact coupling 100 faces the vehicle's coupling direction L and lies in coupling plane M or can be brought into coupling plane M. The electrical contact coupling 100 thereby serves, in conjunction with an electrical contact coupling 100' configured complementary thereto (see FIG. 6), to establish a connection between electrical lines and/or signal lines between two neighboring vehicles, in particular railway vehicles.

As can be seen from the exploded view of FIG. 1, the electrical contact coupling 100 according to the depicted embodiment exhibits a trapezoidal coupling housing 1, on the bottom or base 10 (FIG. 6) of which guide bushings (not shown) can be arranged for displaceably mounting the coupling housing 1 in coupling direction L to a vehicle, in particular a railway vehicle, on (likewise not shown) guide rails. In this way, it is possible for the end face A of the electrical contact coupling 100 housing to not be brought into the coupling plane M until the mechanical coupling of neighboring vehicles has for example been completed. This thus prevents the electrical contact coupling from being damaged when the vehicles to be coupled approach one another.

It is moreover conceivable to provide centering organs on the coupling housing 1, for example in the form of centering pins and corresponding complementary configured centering sleeves, in order to align the electrical contact couplings 100, 100' to be coupled as the vehicles approach one another.

As can be seen from the FIG. 1 depiction, the coupling housing 1 of the depicted embodiment exhibits a substantially rectangular interior in which the coupling elements, respectively the contacts of the electrical contact coupling, can be accommodated. A housing opening 2 facing coupling direction L is configured in the housing end face A of the coupling housing 1.

In the depicted embodiment of the inventive electrical contact coupling 100 this housing opening 2 is completely surrounded by a seal 3. As FIG. 1 shows, the seal 3 exhibits a shape adapted to the outer contour of the coupling housing 1 such that the seal 3 is of substantially trapezoidal shape as a whole. The seal 3 is detachably affixed to a (not explicitly shown) housing front frame of the housing 1. It is hereto conceivable for the seal 3 to comprise a groove-shaped section 8, as can be seen from the cross-sectional view according to FIG. 5*b*. This substantially U-shaped groove section 8 of seal 3 can be positively locked with a (not shown in the drawings) projecting area of the housing front frame. By so doing, the seal 3 can be easily detached from the housing 1 as the need arises to replace same during maintenance work, etc.

Figure 5A:
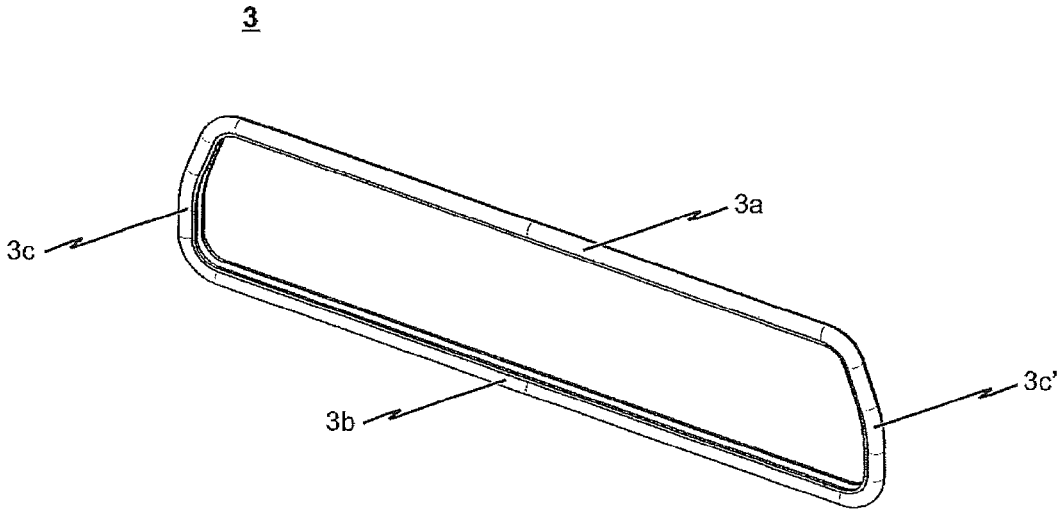
FIG. 5*a* a perspective view of the seal employed in the embodiment of the electrical contact coupling according to FIG. 1.
Figure 5B:
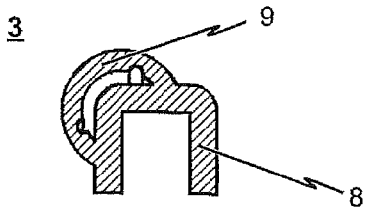
FIG. 5*b* a cross-sectional view of the seal according to FIG. 5*a*.

It can further be noted from the depiction of FIG. 5*b* that the seal 3 exhibits a bead region 9 connected to the groove section 8. This bead region 9 is partially circular in cross section. The bead region 9 faces coupling direction L in the affixed state of the seal 3 on the housing end face A such that, as seen from the front and from above, respectively radially outwardly, the sealing areas 3*a*, 3*b*, 3*c*, 3*c*' utilized to seal the coupling housing 1 are rounded, which allows the seal 3 to be loaded both axially (from the front) as well as radially (from the outside).

It is of course however also conceivable to utilize a circumferential seal of circular cross section (cord ring) affixed to the housing end face A of coupling housing 1.

The electrical contact coupling 100 according to the embodiment depicted in the drawings comprises a protective flap 4 which is articulated to the coupling housing 1 by means of two lateral pivot hinges 6 such that the protective flap 4 can be pivoted relative to the coupling housing 1 about a fixed axis of rotation R from a first position, in which the housing opening 2 is covered, into a second position, in which the housing opening 2 is exposed. A suitable drive 7 can be used to pivot the protective flap 4 about the axis of rotation R. It is however of course also conceivable to mechanically pivot the protective flap 4 relative the coupling housing 1 using a spring or other means.

Figure 6:
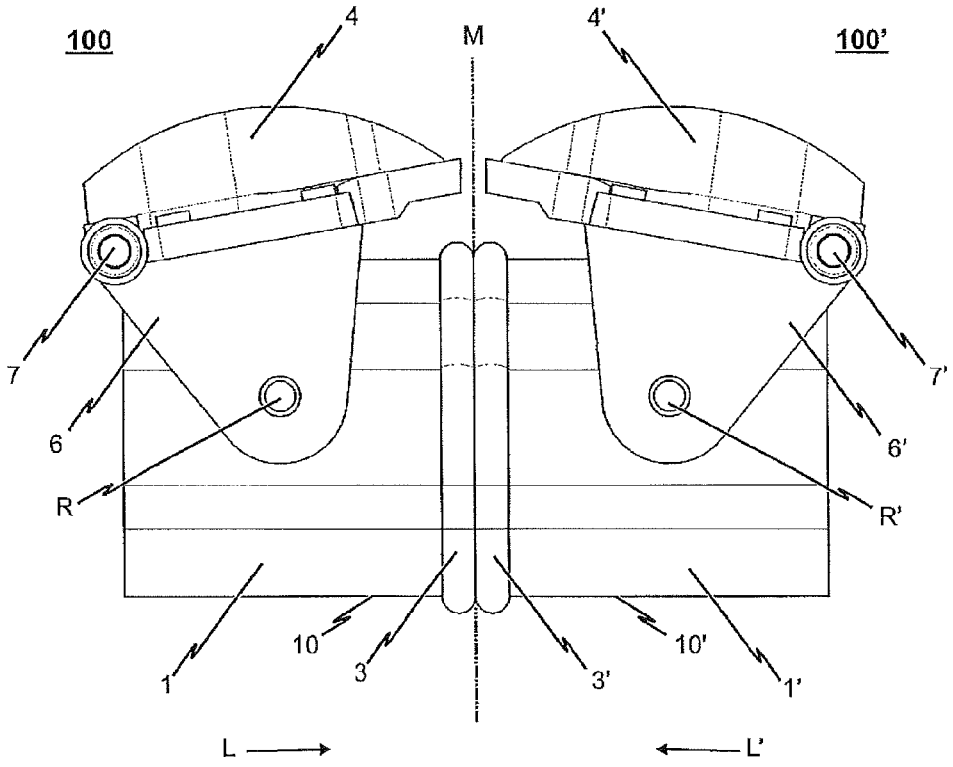
FIG. 6 a side view of the electrical contact coupling according to FIG. 1 in a coupled state with a counter-electrical contact coupling.

As can especially be seen from the FIG. 6 depiction, a single pivot hinge 6 is utilized to pivot the protective flap 4, said pivot hinge 6 connecting the protective flap 4 to the pivot point through which the axis of rotation R extends by means of a single articulated arm.

The protective flap 4 has a rounded inner contour so that it can be pivoted away over the upper edge of the housing.

The interaction between the protective flap 4 and the seal 3 affixed to the housing end face A of the coupling housing 1 will be described in greater detail below with reference being made to the depictions provided in FIGS. 2, 3 and 4. The embodiment of the inventive electrical contact coupling 100 depicted in the drawings is hereby shown in a partly sectional illustration in FIG. 2, wherein the protective flap 4 is in its first position covering the housing opening 2. FIG. 3*b* is a sectional view along the A-A line shown in FIG. 3*a*. The interaction of the protective flap 4 and the seal 3 affixed to the coupling housing 1 in the closed state of the protective flap 4 is easily recognizable in FIG. 3*b*, particularly in the upper and lower area. The manner in which the protective flap 4 interacts with the seal 3 at the lateral sealing gap in the closed state of the protective flap 4 can be noted from FIGS. 3*c* to 3*e*. These figures represent corresponding sectional views along the B-B, C-C and D-D lines shown in FIG. 3*a*.

As can in particular be seen from the FIG. 3*b* depiction, the seal 3 affixed to the housing end face A is allocated into an upper sealing area 3*a* as well as a lower sealing area 3*b*. These two sealing areas 3*a*, 3*b* run substantially parallel to the axis of rotation R about which the protective flap 4 is pivotable relative to the coupling housing 1.

The protective flap 4 exhibits a contact area on its rim which in the first (closed) position of the protective flap 4 contacts the corresponding sealing areas of the seal 3 in order to enable the coupling housing 1 to be sealed against the environment. It is essential here for the contact area of the protective flap 4 to be divided into individual sections, wherein these individual sections are intended for the corresponding sealing areas of the seal 3 and configured accordingly.

Figure 2:
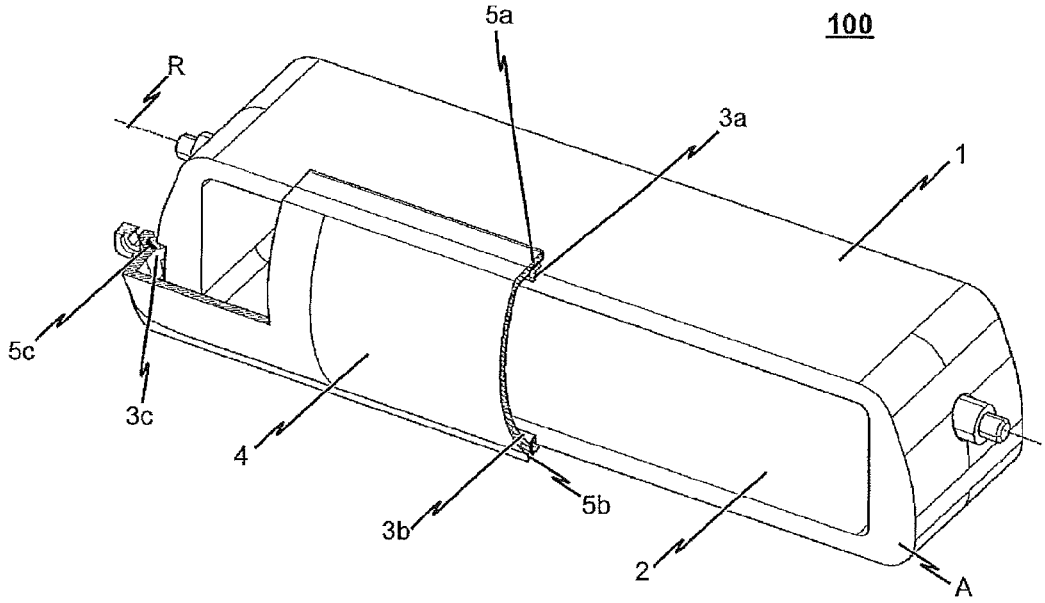
FIG. 2 a partly sectional illustration of the electrical contact coupling according to FIG. 1 in the assembled and closed state.
Figure 3A:
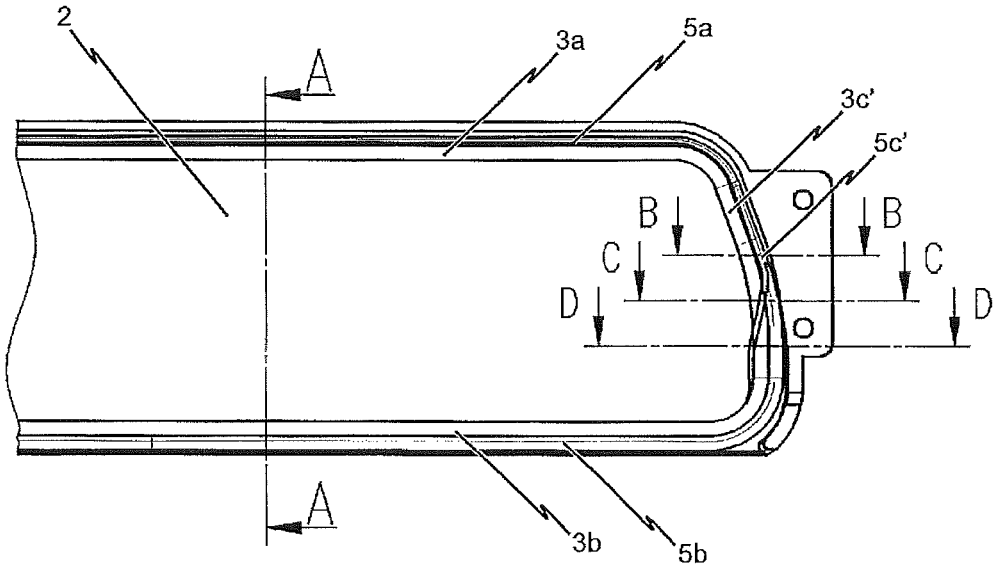
FIG. 3*a* a plan view of part of the housing opening of the electrical contact coupling according to FIG. 1 with the contact area of the protective flap being depicted semi-transparently.
Figure 3B:
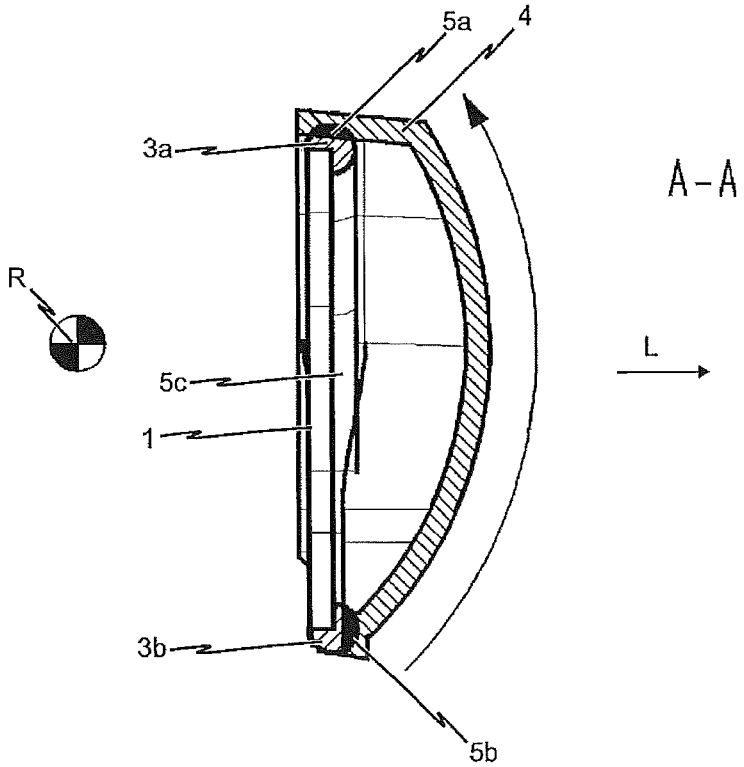
FIG. 3*b* a sectional view along the A-A line from FIG. 3*a;*

As can particularly be seen from the FIGS. 2 and 3*b* depictions, the protective flap exhibits a contact area section configured as sealing face 5*a* to be associated with the upper sealing area 3*a* of the seal 3 which is aligned substantially perpendicular to the housing end face A in the closed state of the protective flap 4. In other words, when the protective flap 4 is in its closed state, the section of the contact area configured as sealing surface 5*a* and associated with the upper sealing area 3*a* radially contacts the upper sealing area 3*a* from the outside.

On the other hand, the protective flap 4 contacts the lower sealing area 3*b* of seal 3 via a contact area section likewise configured as a sealing face 5*b* in the closed state of the electrical contact coupling 100, wherein the contact here, however, is effected from the front. Hence, the contact area section associated with the lower sealing area 3*b* is configured as a sealing face 5*b* aligned substantially parallel to the housing end face A.

Figure 3C:
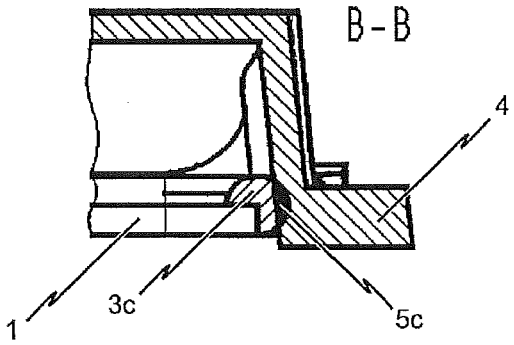
FIG. 3*c* a sectional view along the B-B line from FIG. 3*a;*
Figure 3D:
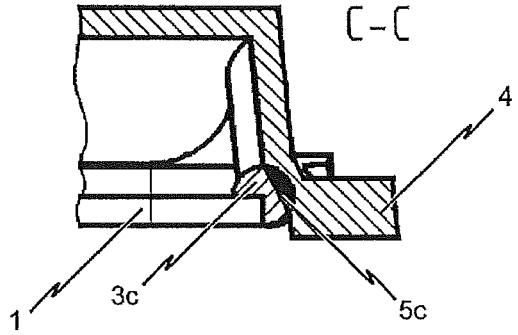
FIG. 3*d* a sectional view along the C-C line from FIG. 3*a;*
Figure 3E:
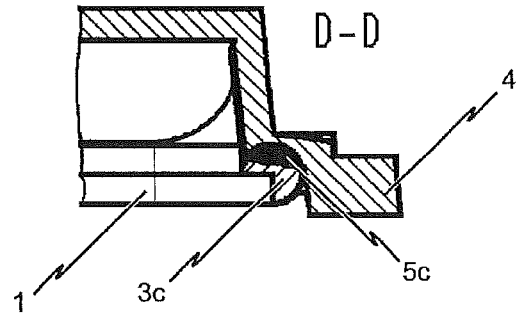
FIG. 3*e* a sectional view along the D-D line from FIG. 3*a;*

The following will make reference in particular to the depictions provided in FIGS. 3*c* to 3*e* in describing the design of the contact area which contacts the lateral sealing areas 3*c*/3*c*' of seal 3 in the closed state of the protective flap 4. In detail, FIG. 3*c* shows a sectional view along the B-B line shown in FIG. 3*a* while FIG. 3*d* shows a sectional view along the C-C line and FIG. 3*e* a sectional view along the D-D line.

A comparison of the sectional views depicted in FIGS. 3*c* to 3*e* directly shows that the section of the contact area which contacts the lateral sealing area 3*c* of seal 3 in the closed state of the protective flap 4 is configured as a three-dimensional sealing face 5*c*. This sealing face 5*c* radially contacts the sealing area 3*c* at the upper area of the lateral sealing area 3*c* from the outside while the sealing area 5*c* contacts the sealing area 3*c* in the lower area of the lateral sealing area 3*c* substantially from the front. The alignment of sealing area 5*c* thereby continuously changes from the state depicted in FIG. 3*c* to the state depicted in FIG. 3*e*. Thus, the section of the contact area associated with the lateral sealing areas 3*c*, 3*c*' is configured as a three-dimensional sealing face 5*c*, 5*c*', the orientation of which is rotated 90°. This can also be particularly noted from the FIG. 4*a* depiction.

Figure 4A:
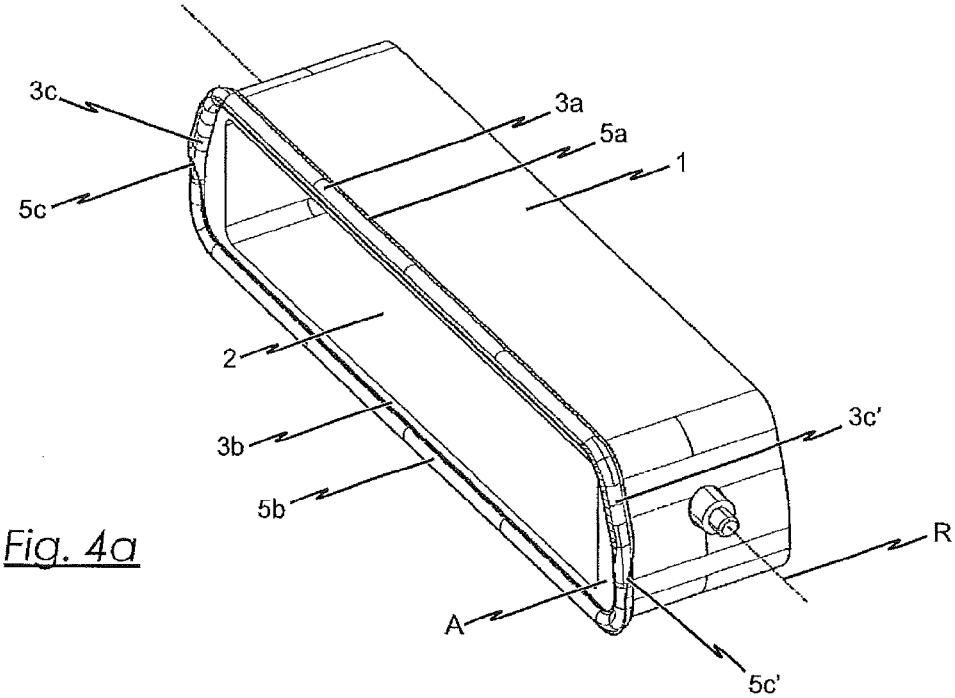
FIG. 4*a* a perspective view of the coupling housing of the electrical contact coupling according to FIG. 1, wherein only the contact area of the protective flap is shown and wherein the protective flap is in its closed state.

Specifically, FIG. 4*a* shows a perspective view of the coupling housing 1 of the exemplary embodiment of the inventive electrical contact coupling 100, wherein for the sake of clarity, only the contact areas of protective flap 4 are shown.

It can in particular be noted from FIG. 4*a* that the individual sealing faces of protective flap 4 merge together tangentially, wherein sealing face 5*a*, associated with the upper sealing area 3*a*, extends substantially horizontally while sealing face 5*b*, associated with the lower sealing area 3*b*, extends substantially vertically. The two lateral sealing faces 5*c*, 5*c*' associated with lateral sealing areas 3*c*, 3*c*' are twisted 90 degrees.

Figure 4B:
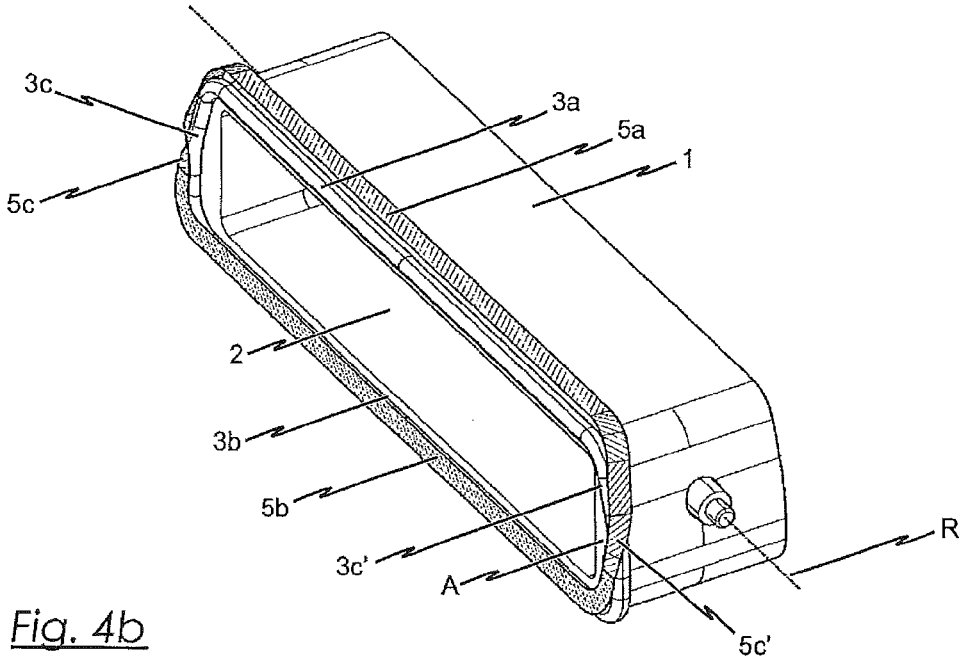
FIG. 4*b* the coupling housing according to FIG. 4*a*, wherein only the contact area of the protective flap is shown and wherein the protective flap is pivoted 10 degrees about the axis of rotation R relative to the coupling housing.

The special configuration to the individual sealing faces 5*a*, 5*b*, 5*c*, 5*c*' of the protective flap 4 ensures that upon the protective flap 4 pivoting relative to the coupling housing 1 about the axis of rotation R, the contact area of the protective flap 4 will not contact the seal until directly prior to reaching the closed position. In so doing, the lateral sealing areas 3*c*, 3*c*' are not subjected to friction until just before the final closed position is reached when the protective flap 4 is pivoted relative to the coupling housing 1. This also yields particularly from the FIG. 4*b* representation, which depicts the coupling housing 1 of the electrical contact coupling 100 shown in the figures in a perspective view, wherein for the sake of the clarity, only the sealing faces 5*a*, 5*b*, 5*c*, 5*c*' of the protective flap 4 pivotably mounted to the coupling housing 1 are shown. In contrast to the FIG. 4*a* depiction, the FIG. 4*b* representation shows the protective flap 4 pivoted 10 degrees relative the coupling housing 1 out of the closed position (cf. FIG. 4*a*).

It is directly apparent that in the state depicted in FIG. 4*b*, the sealing faces of the protective flap 4, and in particular the lateral sealing faces 5*c*, 5*c*', no longer contact the seal 3, and in particular the lateral sealing areas 3*c*, 3*c*', such that the seal 3 is no longer contacted upon the protective flap 4 moving relative to the housing 1, hence nor is it subjected to any friction. In detail, the sealing faces 5*c*, 5*c*' associated with lateral sealing areas 3*c*, 3*c*' are designed so as to not come into contact with the seal (the lateral sealing areas 3*c*, 3*c*') until the last 5° of the protective flap's movement.

It is thus to be noted that with the inventive solution, the protective flap 4 can be pressed firmly against the seal 3 surrounding the housing opening 2 so as to also achieve a tight sealing of the coupling housing 1 in the uncoupled state. On the other hand, there is virtually negligible friction on protective flap 4 when the seal 3 opens or closes such that the seal 3 is not squeezed or worn by friction during such movement. Not until the very start of the opening motion, respectively the very end of the closing motion, does the contact area of the protective flap 4 come into contact with the seal 3.

In FIG. 6, the electrical contact coupling 100 according to the embodiment is adjoined to a correspondingly complementary configured counter-electrical contact coupling 100'. Since the counter-electrical contact coupling 100' is realized in identical construction to electrical contact coupling 100, the individual components of the counter-electrical contact coupling 100' will not be described at this point in any greater detail.

To be noted in particular from the FIG. 6 depiction is that the corresponding seals 3, 3' are pressed against each other in the coupled state of the electrical contact couplings so as to protect the coupling elements, respectively the contacts of the coupled electrical contact couplings 100, 100', from humidity and/or contamination.

The invention is not limited to the embodiment of the electrical contact coupling depicted in the drawings but rather yields from a consideration of all the features disclosed herein.

What is claimed is:

1. An electrical contact coupling for a track-borne vehicle, particularly a railway vehicle, wherein the electrical contact coupling comprises the following:

a coupling housing having a housing opening configured on one housing end face and a seal at least sectionally encircling the housing opening; and a protective flap which is articulated to the coupling housing such that the protective flap can be pivoted relative to the coupling housing about a fixed axis of rotation from a first position, in which the housing opening is covered, into a second position, in which the housing opening is exposed, wherein the seal exhibits an upper sealing area running substantially parallel to the axis of rotation and a lower sealing area running substantially parallel to the axis of rotation, wherein the protective flap has a contact area which contacts the seal in order to seal the coupling housing in the first position of the protective flap, wherein the section of the contact area which contacts the upper sealing area in the first position of the protective flap is configured as a sealing face aligned substantially perpendicular to the housing end face, and wherein the section of the contact area which contacts the lower sealing area in the first position of the protective flap is configured as a sealing face aligned substantially parallel to the housing end face.

2. The electrical contact coupling according to claim 1, wherein the seal furthermore exhibits lateral sealing areas which connect the upper sealing area to the lower sealing area, and wherein the sections of the contact area which contact the lateral sealing areas in the first position of the protective flap are configured as three-dimensional sealing faces which continuously adjoin the sealing faces aligned substantially perpendicular to the housing end face to the sealing faces aligned substantially parallel to the housing end face.

3. The electrical contact coupling according to claim 1, wherein the seal is configured as a circumferential seal and exhibits two lateral sealing areas which are configured mirror-symmetrical to one another and each respectively connect the upper sealing area to the lower sealing area, and wherein each section of the contact area which contacts one of the two lateral sealing areas in the first position of the protective flap is configured as a three-dimensional sealing face which continuously adjoins the sealing face aligned substantially perpendicular to the housing end face to the sealing face aligned substantially parallel to the housing end face.

4. The electrical contact coupling according to claim 1, wherein the seal is detachably affixed to the coupling housing.

5. The electrical contact coupling according to claim 1, wherein the seal is configured as an O-ring made from an elastomer material.

6. The electrical contact coupling according to claims 1, wherein the sealing faces forming the contact area of the protective flap are formed by the machining of said protective flap.

7. The electrical contact coupling according to claim 1, wherein the protective flap is articulated to the coupling housing by means of a single-joint hinge so as to be pivotable.

8. The electrical contact coupling according to claim 1, wherein a drive is further provided to pivot the protective flap about the fixed axis of rotation relative to the coupling housing.

9. The electrical contact coupling according to claim 2, wherein the seal is configured as a circumferential seal and exhibits two lateral sealing areas which are configured mirror-symmetrical to one another and each respectively connect the upper sealing area to the lower sealing area, and wherein each section of the contact area which contacts one of the two lateral sealing areas in the first position of the protective flap is configured as a three-dimensional sealing face which continuously adjoins the sealing face aligned substantially perpendicular to the housing end face to the sealing face aligned substantially parallel to the housing end face.

10. The electrical contact coupling according to claim 2, wherein the seal is detachably affixed to the coupling housing.

11. The electrical coupling according to claim 2 wherein the seal is configured as an O-ring made from an elastomer material.

12. The electrical coupling according to claim 2 wherein the protective flap is articulated to the coupling housing by means of a single-joint hinge so as to be pivotable.

13. The electrical coupling according to claim 2 wherein a drive is further provided to pivot the protective flap about the fixed axis of rotation relative to the coupling housing.

14. The electrical contact coupling according to claim 3 wherein the protective flap is articulated to the coupling housing by means of a single-joint hinge so as to be pivotable.

15. The electrical contact coupling according of claim 14 wherein a drive is further provided to pivot the protective flap about the fixed axis of rotation relative to the coupling housing.

16. An electrical contact coupling for a track-borne vehicle, particularly a railway vehicle, wherein the electrical contact coupling comprises the following:

a coupling housing having a housing opening configured on one housing end face and a seal at least sectionally encircling the housing opening; and a protective flap is connected to the coupling housing by a hinge such that the protective flap can be pivoted relative to the coupling housing about a fixed axis of rotation from a first position, in which the housing opening is covered, into a second position, in which the housing opening is exposed, wherein the seal exhibits an upper sealing area running substantially parallel to the axis of rotation and a lower sealing area running substantially parallel to the axis of rotation, wherein the protective flap has a contact area which contacts the seal in order to seal the coupling housing in the first position of the protective flap, wherein the section of the contact area which contacts the upper sealing area in the first position of the protective flap is configured as a sealing face aligned substantially perpendicular to the housing end face, wherein the section of the contact area which contacts the lower sealing area in the first position of the protective flap is configured as a sealing face aligned substantially parallel to the housing end face, and wherein a drive is provided to pivot the protective flap relative to the coupling housing.

17. The electrical contact coupling according to claim 16, wherein the seal is configured as a circumferential seal and exhibits two lateral sealing areas which are configured mirror-symmetrical to one another and each respectively connect the upper sealing area to the lower sealing area, and wherein each section of the contact area which contacts one of the two lateral sealing areas in the first position of the protective flap is configured as a three-dimensional sealing face which continuously adjoins the sealing face aligned substantially perpendicular to the housing end face to the sealing face aligned substantially parallel to the housing end face.

18. The electrical contact coupling according to claim 16, wherein the seal is detachably affixed to the coupling housing.

19. The electrical contact coupling according to claim 16, wherein the seal is configured as an O-ring made from an elastomer material.

20. The electrical contact coupling according to claim 16, wherein the sealing faces forming the contact area of the protective flap are formed by the machining of said protective flap.

21. A track-borne vehicle, particularly a railway vehicle, having an electrical contact coupling according to claim 1, wherein the electrical contact coupling is mounted or mountable to the vehicle such that the housing end face of the electrical contact coupling faces the vehicle's coupling direction and lies in coupling plane or can be brought into the coupling plane.

22. A track-borne vehicle, particularly a railway vehicle, having an electrical contact coupling according to claim 2, wherein the electrical contact coupling is mounted or mountable to the vehicle such that the housing end face of the electrical contact coupling faces the vehicle's coupling direction and lies in coupling plane or can be brought into the coupling plane.

23. A track-borne vehicle, particularly a railway vehicle, having an electrical contact coupling according to claim 9, wherein the electrical contact coupling is mounted or mountable to the vehicle such that the housing end face of the electrical contact coupling faces the vehicle's coupling direction and lies in coupling plane or can be brought into the coupling plane.

* * * * *